US006296232B1

(12) United States Patent
Roodenburg

(10) Patent No.: US 6,296,232 B1
(45) Date of Patent: Oct. 2, 2001

(54) RISER-TENSIONER

(75) Inventor: Joop Roodenburg, Delft (NL)

(73) Assignee: Huisman Special Lifting Equipment B.V., Ad Schiedam (NL)

( * ) Notice: Subject to any disclaimer, the term of this patent is extended or adjusted under 35 U.S.C. 154(b) by 0 days.

(21) Appl. No.: 09/555,762

(22) PCT Filed: Dec. 15, 1998

(86) PCT No.: PCT/NL98/00716

§ 371 Date: Jul. 14, 2000

§ 102(e) Date: Jul. 14, 2000

(87) PCT Pub. No.: WO99/31345

PCT Pub. Date: Jun. 24, 1999

(30) Foreign Application Priority Data

Dec. 15, 1997 (NL) ..... 1007798

(51) Int. Cl.[7] ..... B66D 3/04
(52) U.S. Cl. ..... 254/392; 254/386; 166/355
(58) Field of Search ..... 254/386, 392, 254/393, 394, 398; 166/355

(56) References Cited

U.S. PATENT DOCUMENTS

| | | | | |
|---|---|---|---|---|
| 915,604 | * | 3/1909 | Hyslop | 254/386 |
| 3,897,045 | | 7/1975 | Butler . | |
| 3,996,755 | | 12/1976 | Kallnowski . | |
| 4,272,059 | * | 6/1981 | Noerager et al. | 254/392 |
| 4,616,708 | * | 10/1986 | Da Mota | 254/392 |
| 4,665,696 | * | 5/1987 | Rosman | 254/386 |
| 5,816,565 | * | 10/1998 | McGuffin | 254/386 |
| 5,957,431 | * | 9/1999 | Serda, Jr. | 254/386 |
| 6,095,501 | * | 8/2000 | Vatne | 254/386 |

FOREIGN PATENT DOCUMENTS

| | | |
|---|---|---|
| 2023 205 | 12/1979 | (GB) . |
| 2 170 240 | 7/1986 | (GB) . |

* cited by examiner

*Primary Examiner*—Emmanuel M. Marcelo
(74) *Attorney, Agent, or Firm*—Sughrue, Mion, Zinn, Macpeak & Seas, PLLC

(57) ABSTRACT

The present invention relates to a riser-tensioner for exerting a tensile force from a drilling vessel or drilling platform upon a riser, comprising a riser ring which is for fastening attachably to the top end of the riser, and one or more cables extending by way of cable pulleys from said vessel or platform to said riser ring, in which said cable pulleys are under such influence or tensioning means that a tensioning force can be applied to the cable, the riser ring being provided with riser ring sheaves and the cables being guided in an outgoing reeving from the vessel or the platform to said riser ring sheaves, and being guided back by way of said riser ring sheaves in a return reeving to said vessel or platform.

7 Claims, 3 Drawing Sheets

RISER-TENSIONER

The present invention relates to a riser-tensioner for exerting a tensile force from a drilling vessel or drilling platform upon a riser, comprising a riser ring which is for fastening attachably to the top end of the riser, and one or more cables extending by way of cable pulleys from said vessel or platform to said riser ring, said cable pulleys being under such influence of tensioning means that a tensioning force can be applied to the cable.

PRIOR ART

During the drilling of a borehole by means of a drill string from a drilling vessel or drilling platform, it is customary to construct below said vessel or said platform a riser which extends to the seabed. The riser encloses the drill string and makes it possible for the drilling fluid to be conveyed from the borehole by way of the radial opening between the outside wall of the drill string and the inside wall of the riser in the direction of the drilling vessel or drilling platform. The drilling fluid contains a great variety of information on the circumstances at the bottom of the well, and the analysis of such information is necessary for achieving the optimum drilling process.

A riser is constructed from riser parts extending from the drilling vessel or drilling platform in the direction of the seabed. The riser is kept under control from the drilling vessel or drilling platform by the fact that a tensile force is exerted upon a riser ring fixed at the top end of the riser. This riser ring is generally connected by means of cables to the drilling vessel or drilling platform, and a tensioning force can be applied to the cables. For this purpose it is known to design the drilling vessel or drilling platform with cable pulleys which are placed on either side of a tensioning cylinder, the cables which extend from the riser ring being conveyed by way of the cable pulleys to a fastening on the platform. The presence of the tensioning cylinders ensures that length variations of the cables, which are caused, inter alia, by movements of the drilling vessel or drilling platform relative to the top side of the riser (read: relative to the seabed), are absorbed. The device by means of which the riser ring is connected to the vessel or platform is also called a riser-tensioner.

A riser-tensioner of the type mentioned in the preamble is known from U.S. Pat. No. 3,897,045. The tensioning means of this known riser-tensioner are formed by cylinders which are provided with cable blocks on either side. These cylinders are placed essentially above the drilling floor. From the blocks placed at the bottom side of the cylinder, cables fastened to the riser ring extend on either side of the riser.

Since drilling is carried out at increasingly great depths by means of drilling vessels and drilling platforms, the risers used are becoming increasingly long, and consequently increasingly heavy. This means that the forces which have to be transmitted by the cables and the cable pulleys are also becoming increasingly great, and thus also the dimensions of the cables and the cable pulleys themselves.

A first major disadvantage of the known riser-tensioner is that, on account of the large cable pulleys which are necessary in the tensioners, an ever-increasing amount of space is needed for the riser-tensioners on board drilling vessels or drilling platforms.

Owing to the movements of the vessel or the platform relative to the riser, the cable will be bent on the various cable pulleys while it is under high tension, with the result that the cables are exposed to great fatigue stresses. From time to time (for example, once a year) the cables on the riser-tensioner must be replaced. Since the cables extend from the vessel or the island and end on the riser ring, the cable must be removed from the riser ring and new cable supplied from the platform to the riser ring. This is a job which cannot be carried out without risks for the workers involved.

Another major disadvantage of the known riser-tensioners is therefore that the replacement of cables in riser-tensioners can be carried out only with great difficulty.

It is the object of the present invention to provide a riser-tensioner which can be provided with relatively small cable pulleys and in which the cable of the riser-tensioner can be replaced simply and rapidly, without the cable having to be removed from the riser ring.

That object is achieved in the present invention by the fact that the riser ring is provided with riser ring sheaves, and that the cables are guided in an outgoing reeving from the vessel or the platform to said riser ring sheaves and are guided back by way of said riser ring sheaves in a return reeving to said vessel or platform. The advantage of the riser-tensioner according to the present invention is that the cable which is supplied from the drilling vessel or drilling platform to the riser ring does not end at the riser ring, but is guided back by way of a return reeving to the drilling vessel or drilling platform. That means that for replacement of the cable in the riser-tensioner the cable can be coiled up at one side and supplied at the other side, without connection or disconnection of the riser ring being necessary.

British Patent Application 2,170,240 discloses a riser-tensioner which comprises a collar, in the case of which a cable is guided from a drilling vessel or drilling platform by way of a first reeving from the drilling vessel or drilling platform to the collar, and by a second reeving from the collar back to the drilling vessel or drilling platform. However, the purpose of this known riser-tensioner is to permit disconnection of the riser safely and quickly when the movements of the drilling vessel or drilling platform relative to the seabed become too violent. This is the case, for example, when there is strong wind which causes high wave action.

When the riser is disconnected at the bottom side, the riser-tensioner according to GB 2,170,240 ensures that the riser is drawn up a certain distance, but cannot overshoot. A stop fixed on the outside wall of the riser will help to move the collar which is fixed around the riser. Owing to the construction of the known riser-tensioner, a downward force is subsequently exerted upon the collar by the cables of the riser-tensioner. That force is transmitted to the riser itself by way of stops mounted on the riser itself.

In normal use the cables of the riser-tensioner run substantially horizontally from the drilling vessel or drilling platform in the direction of the collar. Vertical movements of the riser relative to the drilling vessel or drilling platform are absorbed by the cables fastened to the riser ring at the top side of the riser. During use, the functioning of the riser-tensioner therefore corresponds entirely to that of the riser-tensioner discussed above with reference to U.S. Pat. No. 3,897,045. The riser-tensioner according to GB 2,170,240 also has the same disadvantages during use.

A further disadvantage of the riser-tensioners according to the prior art is that the cable in the riser-tensioner is bent alternately to the left and to the right during winding of the successive pulleys. This alternate bending increases the fatigue to which the cable is exposed.

A further object of the riser-tensioner according to the present invention is to position the cable pulleys in such a way that the cable placed around them can be bent in only one direction.

It is advantageous here for the cable pulleys on said vessel or said platform to be positioned in such a way that the cable is bent in only one direction while it is being placed around the cable pulleys. The advantage of this measure is that the cable is no longer bent in various directions relative to its longitudinal axis. That means that the fatigue stress on the cable—and thus the chance of giving way—is considerably reduced.

It is advantageous here for the riser-tensioner to be fastened below the drilling floor. In this case it is advantageous for the tensioning means of the riser-tensioner to be formed by cylinders, and for the cylinders to be placed in such a way on said vessel or said platform that the cylinder rods of said cylinders are directed vertically downwards. The fact that the riser-tensioner is fastened below the drilling floor facilitates the positioning of the cable pulleys in such a way that the cable is bent in only one direction while it is being placed on the successive pulleys. Another major advantage is that additional space is freed by placing the tensioner below the drilling floor.

The riser-tensioner according to the present invention is further improved by the fact that the riser-tensioner is provided with a cable anchor for fastening the cable ends on the vessel or the platform. The advantage of fastening the cable ends by means of cable anchors is that the cable is easily replaced.

It is also advantageous for the riser-tensioner to comprise a cable storage unit, from which the cable is supplied in the direction of one cable anchor or both cable anchors. The presence of the cable storage unit makes it possible to feed in a new cable from the cable storage unit without complex or time-consuming operations being necessary when the cable in the riser-tensioner is due for renewal.

The present invention will be explained further with reference to the appended drawings, in which.

Figure 1:
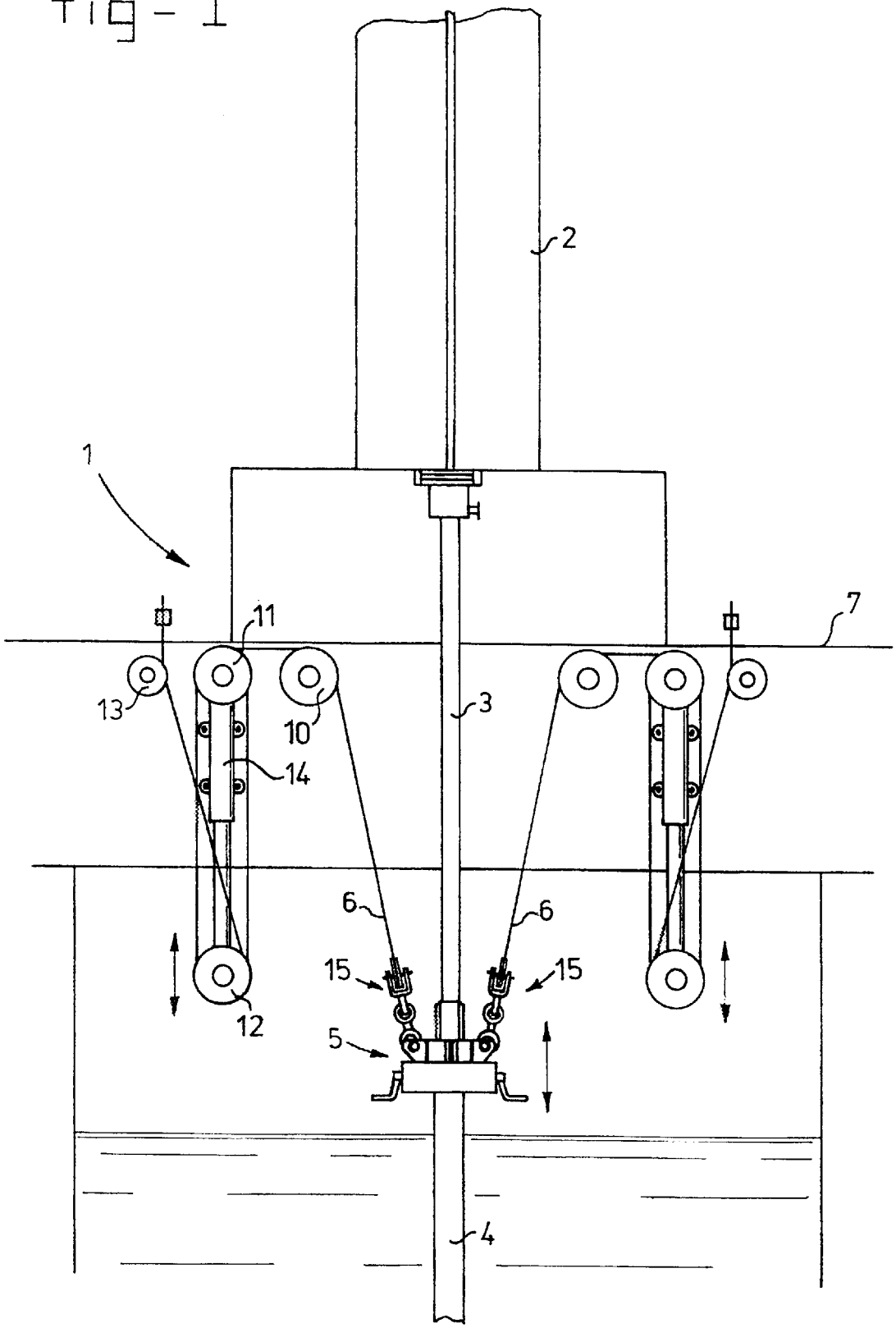
FIG. 1 shows a diagrammatic general view of the way in which the riser ring is fastened to a vessel or platform by means of the riser-tensioners according to the present invention.

FIG. 1 shows diagrammatically a drilling vessel or drilling platform 1. The drilling vessel or drilling platform 1 comprises a mast 2, to which a drilling string 3 is fastened, which drilling string extends in the direction of the borehole (not shown). The drilling string 3 is virtually completely enclosed by a riser 4. A riser ring 5 is fastened at the top end of said riser 4. Cables 6, by means of which a tensile force can be exerted upon the riser 4, are fastened to the riser ring 5. Two cables 6 are shown in FIG. 1. In the prior art it is customary to connect, for example, four, six, eight or twelve cables to the riser ring. The cables 6 extend from the riser ring 5 by way of sheaves 10, 11 and 12 in the direction of the cable anchor 13. The riser-tensioner works as follows: when the drilling vessel or drilling platform moves relative to the earth's surface, for example as a result of wave action, the drilling vessel or drilling platform 1 will also move upwards relative to the riser 4. Since the sheaves 11 and 12 are situated on either side of a cylinder 14, these movements of the drilling vessel or drilling platform relative to the riser 4 can be absorbed. When the drilling vessel or drilling platform 1 moves relative to the riser 4, the cylinder 14 will be depressed, with the result that the distance between the sheaves 11 and 12 is reduced and the free end of the cable 6 between the sheave 10 and the riser-tensioner 5 will increase. When the drilling vessel or drilling platform 1 moves in the direction of the riser 4, the opposite will occur. The riser-tensioner according to the present invention is characterized in that the fastening of the cables 6 on the riser ring 5 is effected by means of sheaves 15. The advantages of this will be explained with reference to FIG. 2.

Figure 2:
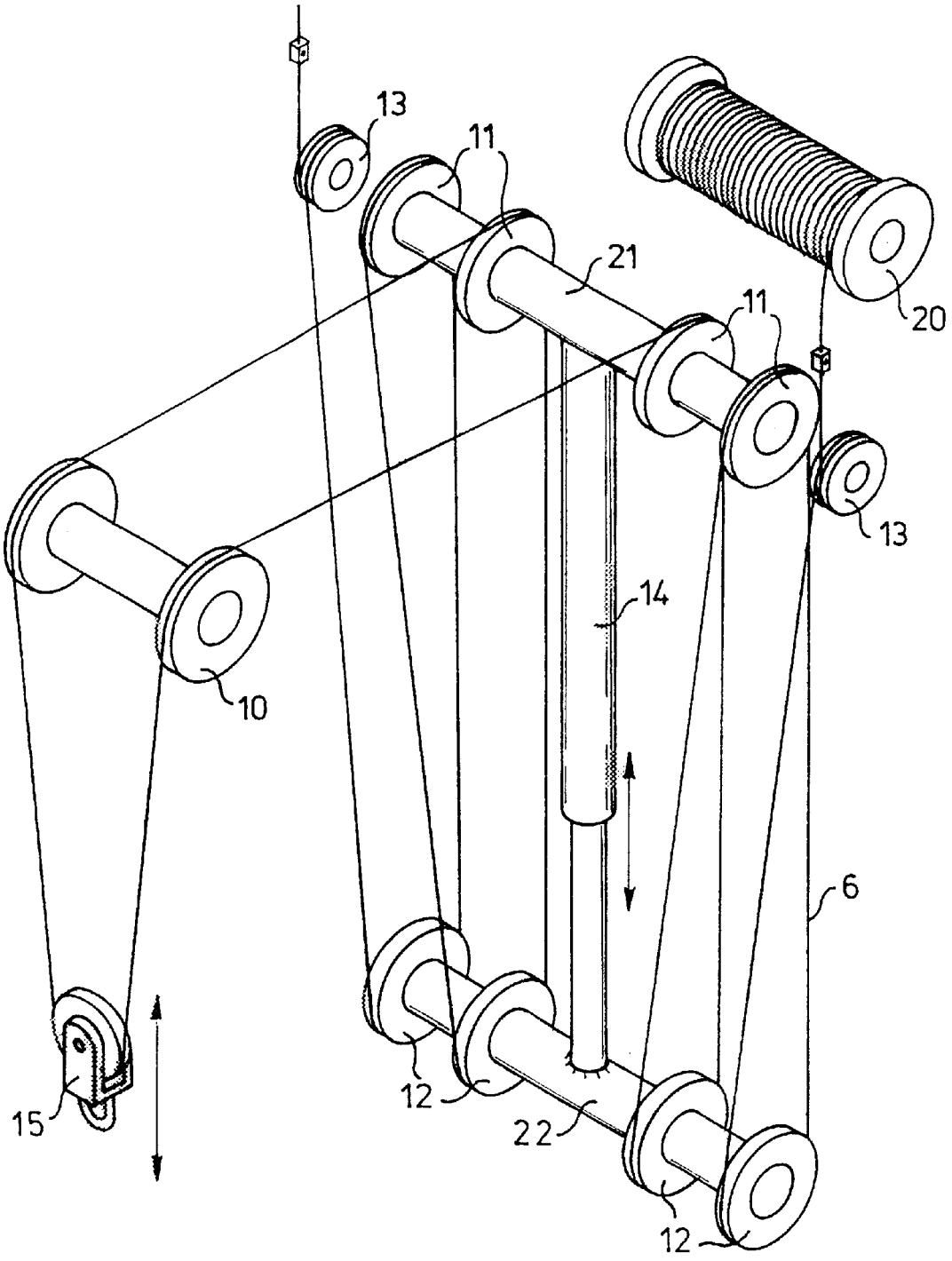
FIG. 2 shows a diagrammatic general view of a first embodiment of the riser-tensioner according to the present invention.

FIG. 2 shows diagrammatically the functioning of the riser-tensioner according to the present invention. It can be seen in the figure that the cable 6 extends from a first cable anchor 13 by way of a first sheave 12 to a first sheave 11, then by way of a second sheave 12 to a second sheave 11, and by way of a first sheave 10 to the sheave 15, which is fastened to the riser ring. The cable 6 extends further in a similar manner to a second cable anchor 13. The sheaves 11 are situated on either side of a shaft 21, and the sheaves 12 are situated on either side of a shaft 22.

During normal operation the cable 6 is stationary relative to the cable anchors 13, and through movement of the cylinder 14 in and out, the distance variations between the riser ring 5 and the drilling vessel or drilling platform can be absorbed, as explained with reference to FIG. 1. The sheave 15 will therefore not move during normal operation. The riser-tensioner according to the present invention therefore acts as a double-reeved riser-tensioner. In the prior art it is customary to provide the riser-tensioners with a single cable 6 which is guided from a fastening point by way of blocks to an end point on the riser ring. As a result of the double reeving according to the present invention, the forces on the cables will be reduced by a factor of 2, so that the sheaves used in the riser-tensioner can be made smaller than what is possible in the prior art. That means that the riser-tensioner according to the present invention can be made smaller and more compact than the riser-tensioner according to the prior art. A second major advantage of the riser-tensioner according to the present invention is that the cable 6 in the tensioner can be replaced in a simple manner. In riser-tensioners the cables are exposed to fatigue stresses. That means that the cable 6 must be replaced from time to time. In the riser-tensioner according to the prior art that means that the fastening of the end point of the cable 6 on the riser ring has to be detached, and a new cable has to be fixed to the riser ring. In practice, this is found to be an operation which is not only time-consuming, but also involves dangers. In the riser-tensioner according to the present invention the replacement of the cable 6 is carried out as described below. By means of the first cable anchor 13 (on the right in the drawing), wire is supplied from a wire storage unit 20 in the direction of the second cable anchor 13. The second cable anchor 13 (on the left in the figure) is used to remove the part of the cable 6 which has to be replaced. In this way a new cable 6 can be supplied by way of the sheaves 12, 11 and 10 in the direction of the sheave 15. That means that replacement of the cable 6 can be carried out not only quickly, but also without dangers. During the fitting of a new piece of cable 6, not only the sheaves 10, 11 and 12, but also the sheave 15 will rotate.

A further advantage of the riser-tensioner according to the present invention emerges from FIGS. 1 and 2. The cable 6 is always bent in the same direction on the successive sheaves 12, 11, 10, 15 etc. That means that unnecessary fatigue stress as a result of the alternate bending of the cable 6 to the left and to the right is prevented. It can be seen from FIG. 1 that this advantage is achieved by placing the cylinders 14, to which the sheaves 11 and 12 are fastened on either side, below the deck 7 close to the drilling string 3. In riser-tensioners according to the prior art such a configuration is generally not possible, on account of lack of space. Owing to the double reeving of the cable 6 in the riser-tensioner according to the present invention and the resulting small sheaves which will suffice, this advantageous configuration is in fact possible in the present invention, which has additional advantages. For the space above the drilling floor must be arranged as efficiently as possible. By now removing the relatively large riser-tensioners above the drilling floor and placing them below the drilling floor, the relatively scarce space at the top side of the drilling floor is cleared, and the riser-tensioners can be placed below the drilling floor, where in principle there is sufficient space.

As can be seen from FIG. 1, the cylinders 14 are preferably placed with the rod side directed vertically downwards. That means that the rods can move freely up and down in the open space below the drilling floor.

Figure 3:
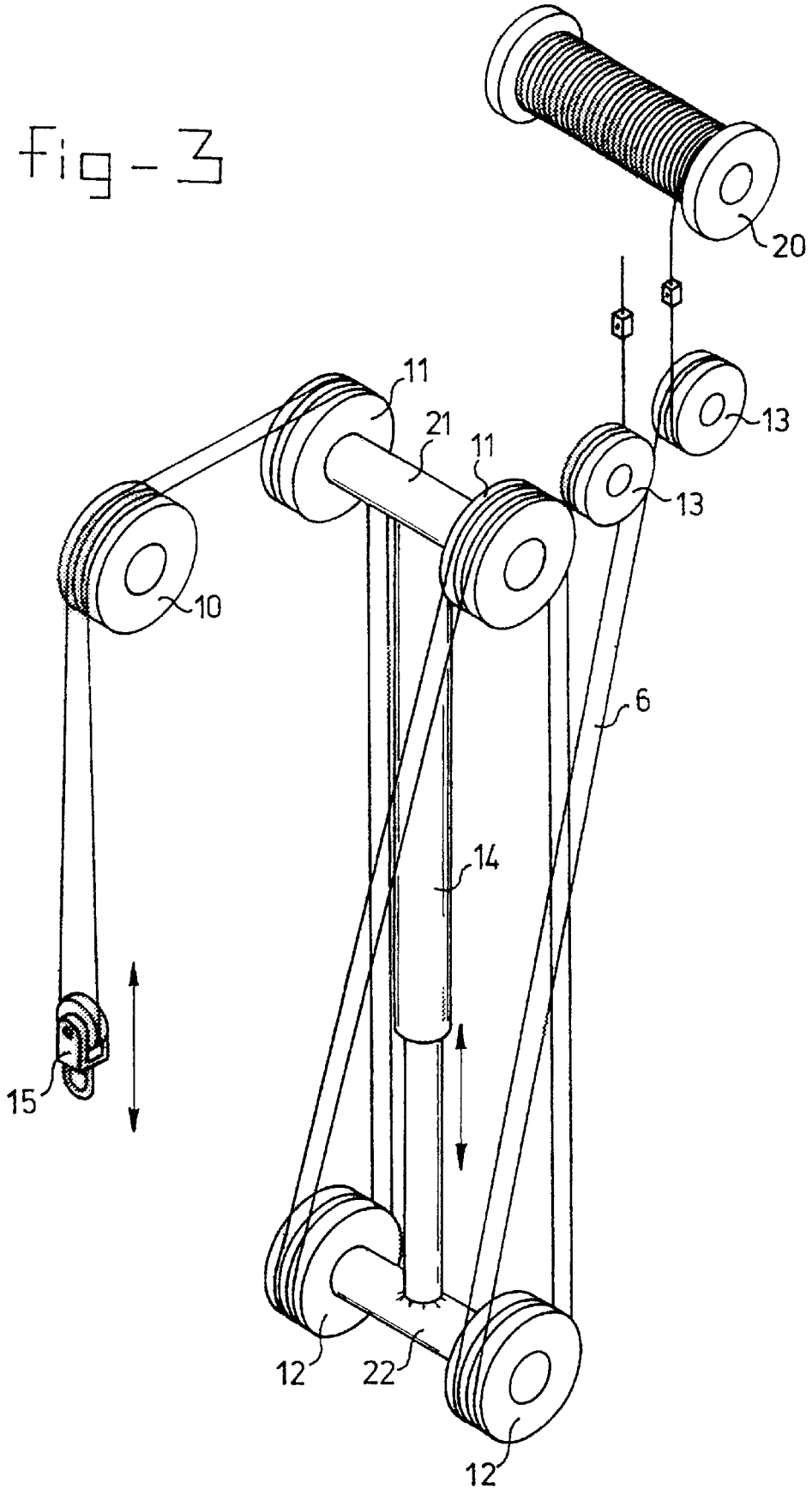
FIG. 3 shows a view of a second embodiment of the riser-tensioner according to the present invention.

FIG. 3 shows a second embodiment of the riser-tensioner according to the present invention. In this riser-tensioner also, the cable 6 extends from a first cable anchor 13 by way of blocks 12, 11 and 10 in the direction of the sheave 15, which is fastened to the riser ring (not shown). The advantage of the configuration from FIG. 3 is that the cable anchors can be fastened next to each other on the vessel or the platform. In the figure the sheaves 11 and 12 on either side of the shafts 21 and 22 are shown as two separate sheaves. It is, of course, also possible to design these sheaves as a single sheave in which there are two grooves through which the cable 6 is passed, in which case (during the feeding in of a new piece of cable) the cables 6 slip, for example, relative to the sheaves 11 and 12.

What is claimed is:

1. Riser-tensioner for exerting a tensile force from a drilling vessel or drilling platform upon a riser, comprising a riser ring which is for fastening attachably to the top end of the riser, and one or more cables extending by way of cable pulleys from said vessel or platform to said riser ring, said cable pulleys being under such influence of tensioning means that a tensioning force can be applied to the cable, wherein the riser ring is provided with riser ring sheaves and that the cables are guided in an outgoing reeving from the vessel or the platform to said riser ring sheaves and are guided back by way of said riser ring sheaves in a return reeving to said vessel or platform.

2. Riser-tensioner according to claim 1, wherein the cable pulleys are positioned on said vessel or said platform in such a way that the cable is bent in only one direction while it is being placed around the cable pulleys.

3. Riser-tensioner according to claim 1, wherein the riser-tensioner is fastened below the drilling floor.

4. Riser-tensioner according to claim 3, wherein the tensioning means of the riser-tensioner are formed by cylinders, and the cylinders are placed in such a way on said vessel or said platform that the cylinder rods of said cylinders are directed vertically downwards.

5. Riser-tensioner according to claim 1, wherein the riser-tensioner is provided with cable anchors for fixing the cable ends on the vessel or the platform.

6. Riser-tensioner according to claim 1, wherein the riser-tensioner also comprises a cable storage unit, from which the cable is supplied in the direction of one cable anchor or both cable anchors.

7. Drilling vessel or drilling platform, wherein the drilling vessel or drilling platform comprises a riser-tensioner according to claim 1.

* * * * *